US010043496B2

(12) United States Patent
Bradley et al.

(10) Patent No.: US 10,043,496 B2
(45) **Date of Patent: *Aug. 7, 2018**

(54) GUITAR PICK

(71) Applicant: Thalia Capos LLC, Orinda, CA (US)

(72) Inventors: Christopher Michael Bradley, Orinda, CA (US); Daniel William Cornish, Moraga, CA (US)

(73) Assignee: Thalia Capos LLC, Orinda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,868

(22) Filed: Dec. 1, 2017

(65) Prior Publication Data

US 2018/0114510 A1 Apr. 26, 2018

Related U.S. Application Data

(63) Continuation of application No. 15/448,405, filed on Mar. 2, 2017, now Pat. No. 9,865,236.

(60) Provisional application No. 62/373,318, filed on Aug. 10, 2016.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | |
|---|---|---|---|
| 4,993,302 | A | 2/1991 | Jonathan |
| D330,905 | S | 11/1992 | Thomas |
| 5,271,308 | A | 12/1993 | Balog |
| 5,894,097 | A | 4/1999 | Barry |
| 6,777,602 | B2 | 8/2004 | Hautamaki |
| 6,835,881 | B1 | 12/2004 | Jackson |
| 2006/0156895 | A1 | 7/2006 | Judd |
| 2008/0163737 | A1 | 7/2008 | Grant |
| 2010/0180748 | A1 | 7/2010 | Frederick |
| 2013/0092008 | A1 | 4/2013 | Murphy |

*Primary Examiner* — Kimberly Lockett
(74) *Attorney, Agent, or Firm* — NetLawyers LLP; Benedict O'Mahoney

(57) ABSTRACT

The present invention is directed to a guitar pick or plectrum for use with a stringed musical instrument and which is constructed with generally two or three veneers which are adhered to each other such that each veneer is cross grain to each adjacently adhered veneer. In other embodiments, the tip portion of the plectrum has a gauge less than the grip portion of the plectrum.

16 Claims, 18 Drawing Sheets

GUITAR PICK

CROSS-REFERENCE TO RELATED APPLICATIONS

The present application is a continuation of co-pending U.S. patent application Ser. No. 15/448,405 filed on Mar. 2, 2017, which claims the benefit of U.S. Provisional application No. 62/373,318 filed on Aug. 10, 2016 both entitled Guitar Pick and incorporated by reference herein and for which benefit of the priority date is hereby claimed.

FEDERALLY SPONSORED RESEARCH

Not applicable.

SEQUENCE LISTING OR PROGRAM

Not applicable.

FIELD OF INVENTION

The subject matter of the present application relates to a pick or plectrum for use with guitars and similar stringed musical instruments.

BACKGROUND OF THE INVENTION

Guitar picks or plectrums are typically made from triangular pieces of one uniform material such as metal, plastic, wood, and others. They are generally shaped in an acute isosceles triangle with two equal corners rounded and the third corner less rounded. The picks generally have flat bodies and the area delineated by the two more-rounded corners are used for grasping between thumb and finger, and the less-rounded playing corner or tip is used to strum or pluck the strings of the guitar.

Different tones have been achieved by manipulating the structure of the pick, including the addition of apertures, and by manipulating the materials used in the construction of the pick. Examples of picks utilizing the manipulation of materials include U. S. Pat. No. 4,993,302 to Jonathon disclosing a tri-ply pick comprising a thin piece of plastic sandwiched by glue with two pieces of rubber to make it easier to grip. U.S. Pat. No. 5,271,308 to Balog discloses a hard plastic guitar pick and hard felt bonded by silicone glue, wherein the pick helps produce improved picking techniques, an easier grip, and different musical tones.

U.S. Pat. No. 6,835,881 to Jackson discloses a pick with a key ring hole and centrally-located disc constructed from non-slippery material. U.S. Patent Application No. 2008/0163737 to Grant discloses a guitar pick comprising flat metal stock of an oval shape, having a ridge of a rounded cross-section on one side near the leading edge, and preferably decorative and/or informative designs or words permanently imprinted on the top and/or bottom.

Examples of picks utilizing the structure and apertures include U.S. Patent Application No. 2006/0156895 to Judd which discloses a cutout section that traverses the center of the pick to create a hinge point at each side of the pick allowing the pick to have extreme flexibility when strumming. U.S. Patent Application No. 2010/0180748 to Frederick discloses apertures disposed through a pick at predetermined locations, such apertures providing a gripping means which enables a user to grasp and control such pick.

U.S. Patent Application No. 2013/0092008 to Murphy discloses a guitar pick with at least three corners, at least two of which have a different gauge or stiffness to produce different sounds on a guitar, wherein the pick is generally symmetrical and all corners are "playing" corners of different gauge, intended for use across the strings of a guitar.

Similarly, U.S. Design Pat. No. D330,905 to Thomas discloses a guitar pick with different elevations. U.S. Pat. No. 6,777,602 to Hautamaki discloses a substantially planar central gripping portion and three or more substantially planar picking wing portions peripherally extending one each in a respective different longitudinal direction from the central gripping portion, such that only one of the wing portions may be used at any one time, such that the wing portion, and wherein each of the wing portions is of a different relative thickness, so as to produce a different relative tone when each is respectively used. U.S. Pat. No. 5,894,097 to Barry discloses a pick where the mid-portion of a wire extends outwardly from the body to form a string-engaging pick portion having a rounded, polished tip for picking the strings of the musical instrument.

Material in general has an effect on the characteristics provided by a plectrum. Metal picks produce a brighter sound than plastic. They are more durable than plastic or wood, but have the disadvantage of quickly wearing the strings of the instrument and damaging the finish of the instrument.

Plastic is the most popular material for picks. Plastic picks produce a darker sound than metal and a colder tone than wood. Plastic picks are less durable than metal, but more durable than wood. Most picks are made of various type of plastic, including celluloid, nylon, acetal (Delrin), and lexan. Plastic picks are relatively easy to mass produce and tend to be significantly cheaper than wood picks.

Wood picks generally produce a warmer tone than metal or plastic. Wood picks have a unique characteristic in that each species of wood produces a unique sound resulting from differences in density, hardness and cellular structure. Wood picks are less durable that metal or plastic, and as a result tend to be thicker than metal or plastic picks. Additionally, wood picks tend to break more easily than plastic, especially along the grain lines of the wood. Wood picks are difficult to mass produce, and tend to be substantially more expensive than plastic picks.

Picks are often differentiated by gauge, meaning their relative stiffness or degree of flexibility. Different stiffness is achieved by using different thicknesses of the same material, or by using different materials. Picks of different gauge produce different sounds, tones, and playability. Generally, a heavier or thicker pick produces a darker sound than a lighter or thinner pick. As a general guide, the thickness of extra light picks are 0.44 mm or less; light picks range from 0.45 mm to 0.69 mm; medium picks range from 0.70 mm to 0.84 mm; heavy picks range from 0.85 mm to 1.20 mm; and extra heavy picks are 1.50 mm or more.

While the foregoing examples of guitar pick are usable for their intended purposes, a need still exists in the art for an improved guitar pick. In particular, there is a need for an improved guitar pick providing the warm tones of wood with the durability associated with the colder sounding materials such as plastic.

SUMMARY OF THE INVENTION

In accordance with the present invention, there is a guitar pick or plectrum that provides improved playability, warmer tonal qualities and durability. The present invention provides a relatively thin wooden pick that has strength, but also bends well. In one embodiment of the present invention, a laser is used to etch both sides of the tip area of the plectrum, making the etched area more pliable and flexible for improved string engagement of the plectrum.

In one embodiment of the present invention, the plectrum is a standard shape and size. Generally, plectrums are shaped in an acute isosceles triangle with two equal corners rounded and the third corner less rounded, or pointed. In this configuration, the less rounded corner used for string engagement would be the apex with the two legs extending from the apex up and outward to the base. The apex and area comprising a minority of the body delineated by the apex and two legs is the tip of the plectrum, and is used to engage the strings of a musical instrument. The base and area comprising a majority of the body delineated by the base and two legs is the grip of the plectrum, and is the portion gripped by the musician, generally with the thumb and forefinger.

It is advantageous to have the grip as thick and stiff as possible, as it makes gripping the plectrum easier and more secure, but it is advantageous to have the tip more flexible, as it makes the playability and sonic characteristics more pleasing.

Specifically, the present invention provides a plectrum of constructed from two or more layers of wood veneer which are adhered to each other such that each veneer is cross grain to each veneer to which it is adhered. For example, one embodiment of the present invention is a two-ply plectrum. For a two-ply plectrum, if a first ply veneer has grain running vertically, it would be adhered to a second ply veneer with a grain running other than vertically. In one embodiment of the present invention, the second ply veneer would be applied with its grain running horizontally, or at 90 degrees from the grain of the first ply veneer. In one embodiment of the present invention, the second ply veneer would be applied with its grain running at an offset of between 30 degrees and 90 degrees from the grain of the first ply veneer. Application of the veneers in a cross grain configuration greatly increases the durability of plectrum. In other words, the present invention makes a plywood out of the veneer. In a two-ply embodiment, you rotate one of the plys from between 30 degrees to 90 degrees so that when placed together, the respective grains are running at angles to each other. Alternatively, in a two-ply embodiment, one of the plys is rotated by 90 degrees so that when placed together, the respective grains are running at 90 degree angles to each other.

Wood plectrums are generally prized for the warmer tones they generate, but tend to break quickly because the stress applied to the plectrum tends to cause a failure on the weakest grain. By applying the veneers in a cross grain configuration, this failure mode is avoided.

The strength is further increased in a three-ply plectrum in which there are three plys in which the grains of the two outer plys run in the same direction, and the interior ply runs in a direction 90 degrees to the outer plys. Two-ply and three-ply plectrums have different technical properties, whereby the two-ply is more flexible, and the three-ply is thicker and more durable.

In another embodiment of the present invention, if a first ply veneer has grain running vertically, it would be adhered to a second ply veneer with a grain running horizontally, which in turn would be adhered to a third ply veneer with a grain running vertically. In a three-ply embodiment, the first and third layers have the grain running in the same direction, and you rotate the second plys from between 30 degrees to 90 degrees so that when placed together, the grain of the second layer is running at an angle to the first and third layers. Alternatively, in a three-ply embodiment, the first and third layers have the grain running in the same direction, and you could rotate one of the plys by 90 degrees so that when placed together, the grain of the second layer is running at a 90 degree angle to the first and third layers. Alternatively, in a three-ply embodiment, the first and third layers have the grain running in different directions, and you could rotate one of the plys so that when placed together, the grain of the second layer is running at different angles to both the first and the third layer. By applying the veneers in this cross grain fashion, the plectrum can provide the warm tones associated with wood plectrums without the unwieldy thickness normally associated with wood plectrums.

In order to provide increased thickness in the grip and flexibility in the tip, in one embodiment of the present invention, one or more of the veneers are manipulated such that the grip has more thickness, or a heavier gauge, then the tip. In one embodiment of the present invention, the tip area of the at least one of the veneers is subject to a laser which burns off a portion of the veneer such that the tip portion of the veneer has a desired thickness, and such thickness is less than the grip.

For example, light pick might be 0.40 mm. This would not be uncommon for a plastic pick made of Delrin or similar material. This is fairly thin to grip. This would be too thin for wood, which would break to easily at that thickness. In one embodiment of the present invention, a first ply veneer with a thickness of 0.45 mm would be subjected to a laser such that 0.25 mm is burned off of the tip area, leaving the tip with a thickness of 0.20 mm and grip with a thickness of 0.45 mm. Then, a second ply veneer with a grain running a different direction than the first ply veneer, also with a thickness of 0.45 mm would be subjected to a laser such that 0.25 mm is burned off of the tip area, leaving the tip with a thickness of 0.20 mm and grip with a thickness of 0.45 mm. Then, the first ply veneer is isomorphically adhered to the second ply veneer so that the base, or grip area, and apex, or tip area, of each veneer matches. Additionally, the first ply veneer is adhered to the second ply veneer so that the surfaces that have been burned off are facing outwards, and the surfaces that have not been burned off are adhered to each other. After the first ply veneer and second ply veneer have been adhered to each other, the plectrum will have a tip with a thickness of 0.40 mm, providing a flexible, yet durable, tip for string engagement, and a grip with a thickness of 0.90 mm, providing a stiff and secure area for gripping.

As another example, a medium-heavy pick might be 0.85 mm. In one embodiment of the present invention, a first ply veneer with a thickness of 0.45 mm would be subjected to a laser such that 0.25 mm is burned off of the tip area, leaving the tip with a thickness of 0.20 mm and grip with a thickness of 0.45 mm. Then, a third ply veneer with a grain running the same direction as the first ply veneer, also with a thickness of 0.45 mm would be subjected to a laser such that 0.25 mm is burned off of the tip area, leaving the tip with a thickness of 0.20 mm and grip with a thickness of 0.45 mm. Then, the first ply veneer is isomorphically adhered to a second ply veneer with a thickness of 0.45 mm and a grain running a different direction that the first ply veneer, so that the base, or grip area, and apex, or tip area, of each veneer matches. Then, the third ply veneer is isomorphically adhered to the other side of the second ply veneer, so that the base, or grip area, and apex, or tip area, of each veneer matches. Additionally, the first ply veneer and third ply veneer are adhered to the second ply veneer so that the surfaces that have been burned off are facing outwards, and the surfaces that have not been burned off are adhered to the second ply veneer. After the first ply veneer, second ply veneer, and third ply veneer have been adhered to each other, the plectrum will have a tip with a thickness of 0.85 mm, providing a flexible, yet durable, tip for string engagement, and a grip with a thickness of 1.35 mm, providing a stiff and secure area for gripping. In one embodiment of the present invention, the veneers are adhered to each other with a room temperature vulcanization adhesive.

By using this method, the tip area can be burned to any specific depth. Additionally, by increasing the energy of the laser as it moves towards the edge of the veneer, a beveled edge can be achieved. Also, rather than burning off a specific area of the tip, the laser can be used to raster out patterns, such as a honeycomb, which increase the flexibility of the tip while retaining more structure.

In another embodiment of the present invention, instead of using a second ply veneer, an isomorphic piece of plastic, such as Delrin, is adhered to the first ply veneer and third ply veneer.

As the grip is thicker and more structurally robust, further enhancements can be made. For example, apertures can be made to change the characteristics, inserts such as abalone and shell can be applied, custom initials or logos and be engraved or rastered, and the surface of the grip can be rastered by a laser to change the gripping surface characteristics, such as thickness, smoothness, patterns, and shape (such as mini pockets for tactile feedback).

There are additional features to using the veneers. For example, different woods in the veneer can be used to match guitars. Additionally, different species of woods in the veneers have different properties that can be optimized for the user. Users can thereby choose the most aesthetically pleasing plectrum, with the type of audio characteristics from the type of wood, thickness, and rastered pattern desired by the user.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Before the invention is described in further detail, it is to be understood that the invention is not limited to the particular embodiments described, as such may, of course, vary. It is also to be understood that the terminology used herein is for the purpose of describing particular embodiments only, and not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed with the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, if dates of publication are provided, they may be different from the actual publication dates and may need to be confirmed independently.

It should be further understood that the examples and embodiments pertaining to the plectrums disclosed herein are not meant to limit the possible implementations of the present technology. Further, although the subject matter has been described in a language specific to structural features and/or methodological acts, it is to be understood that the subject matter defined in the appended claims is not necessarily limited to the specific features or acts described above.

Rather, the specific features and acts described above are disclosed as example forms of implementing the Claims.

Figure 1:
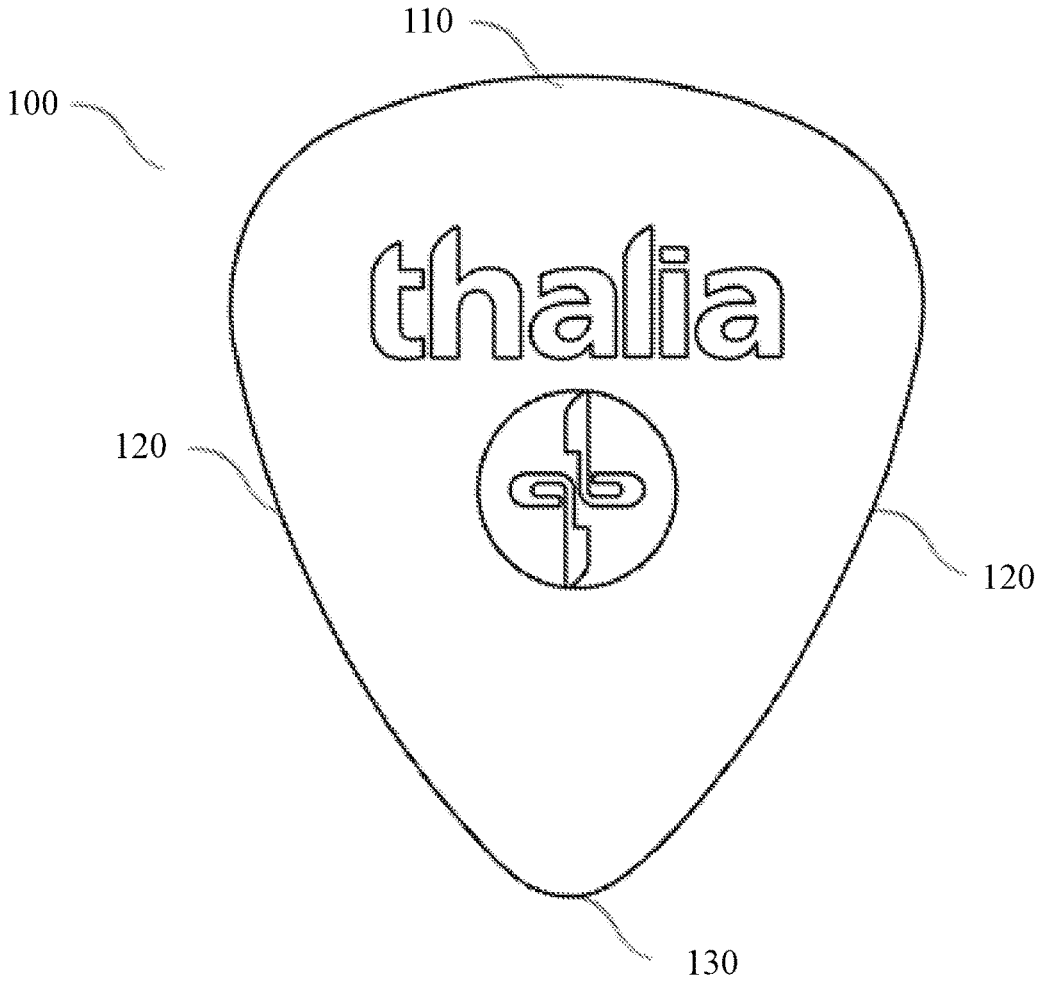
FIG. 1 is a front view drawing of a plectrum.

Initially referring to FIG. 1, shown is a front view of a plectrum 100 delineated by a base 110, two legs 120, and an apex 130.

Figure 2:
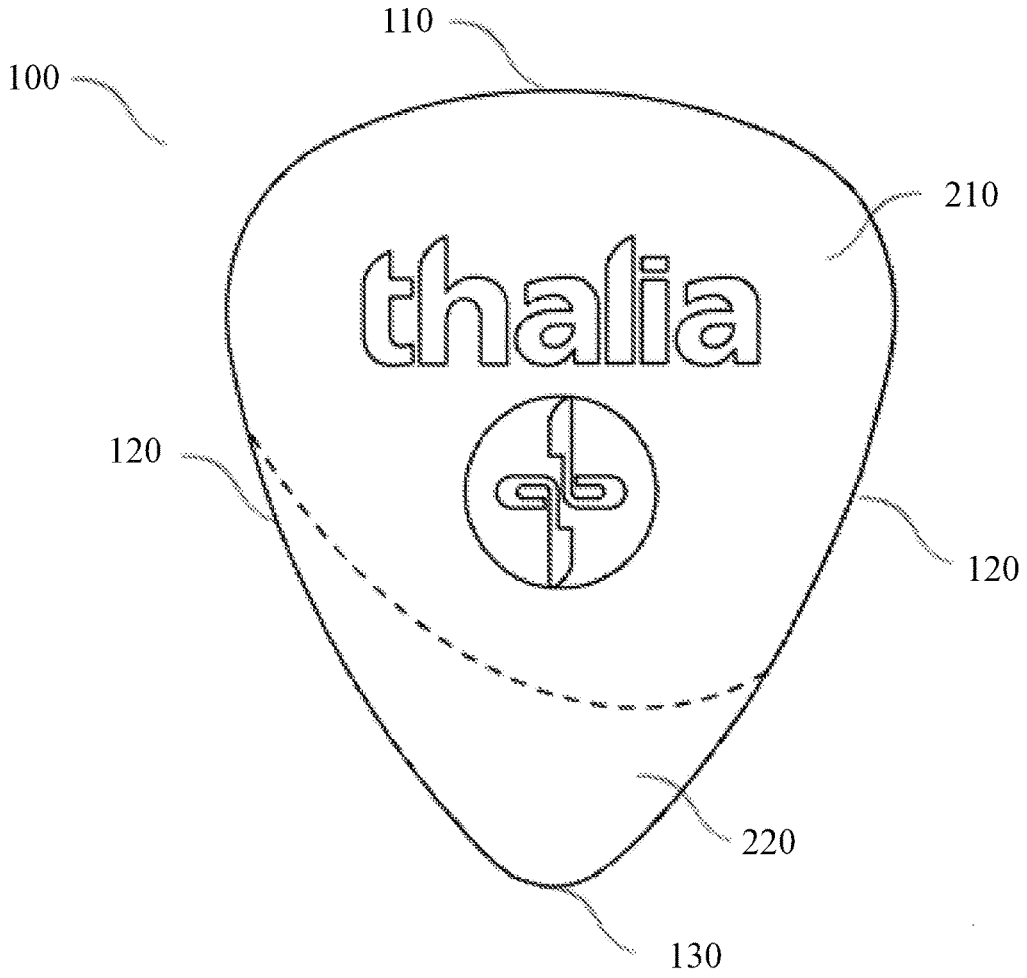
FIG. 2 is a front view diagram of a plectrum with a grip and a tip.

Turning now of FIG. 2, shown is a front view of a plectrum in which can be discerned the grip 210 and the tip 220. The grip 210 is the portion of the plectrum that is gripped by the user, and the tip 220 is the portion of the plectrum that engages with the strings of an instrument. In one embodiment of the present invention, a portion of the tip 220 is rastered such that the width of the rastered portion of the tip 220 is less the unrastered portion of the grip 210.

Figure 3:
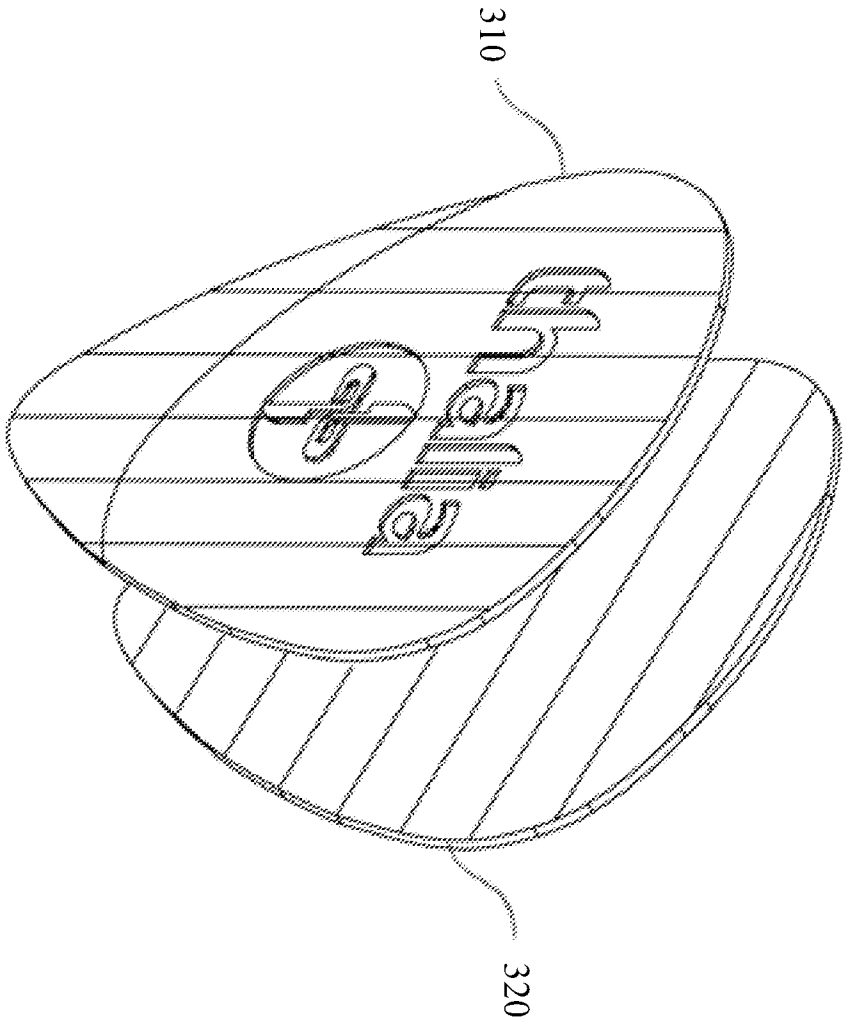
FIG. 3 is a front oblique view drawing of a first ply veneer and second ply veneer.

Turning now to FIG. 3, shown is an exploded front oblique view of a plectrum showing a first ply veneer 310 in which the grain orientation runs vertically along the axis extending from the base to the apex, and a portion of the tip has been rastered and a second ply veneer 320 in which the grain orientation runs horizontally at a 90 degree angle from the vertical axis. When the first ply veneer 310 is adhered to the second ply veneer 320, the different grain orientations of the veneers provide additional strength and durability to the plectrum 100.

Figure 4:
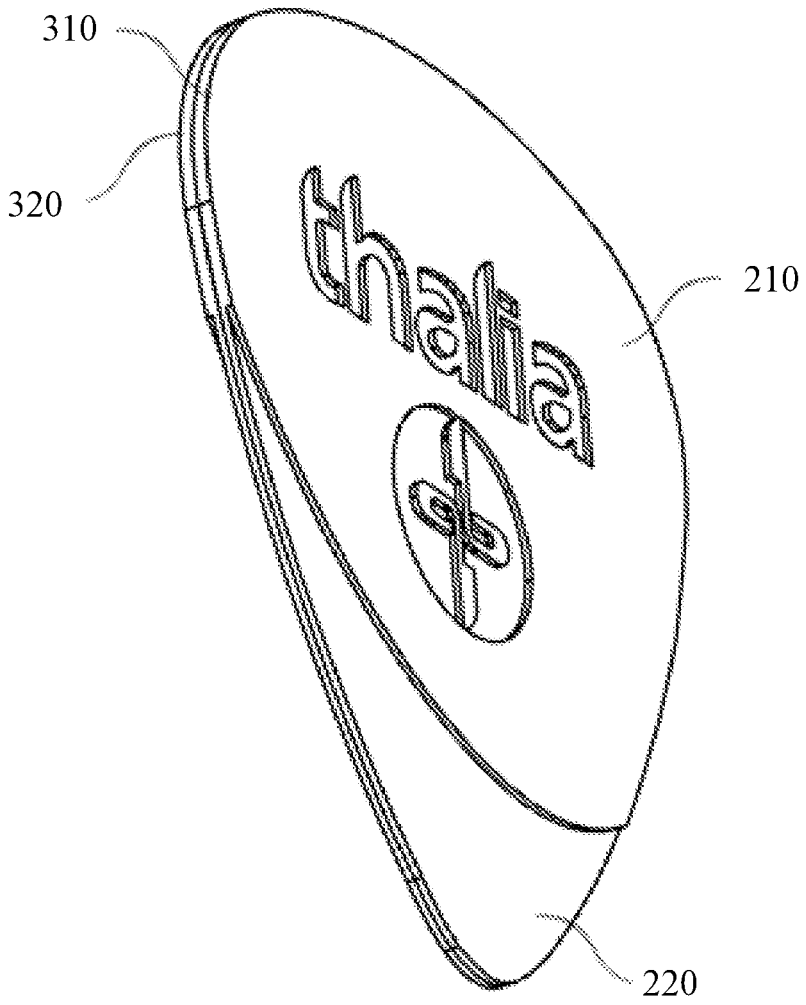
FIG. 4 is a front oblique view drawing of a two-ply veneer plectrum.

Turning now to FIG. 4, shown is a front oblique view of a plectrum 100 in which a first ply veneer 310 has been isomorphically adhered to a second ply veneer 320 in which can be discerned the grip 210 and the tip 220. Additionally, as shown, portions of the tip on both the first ply veneer 310 and second ply veneer 320 have been rastered, thereby providing for a thinner tip 220 with greater flexibility than the thicker grip 210.

Figure 5:
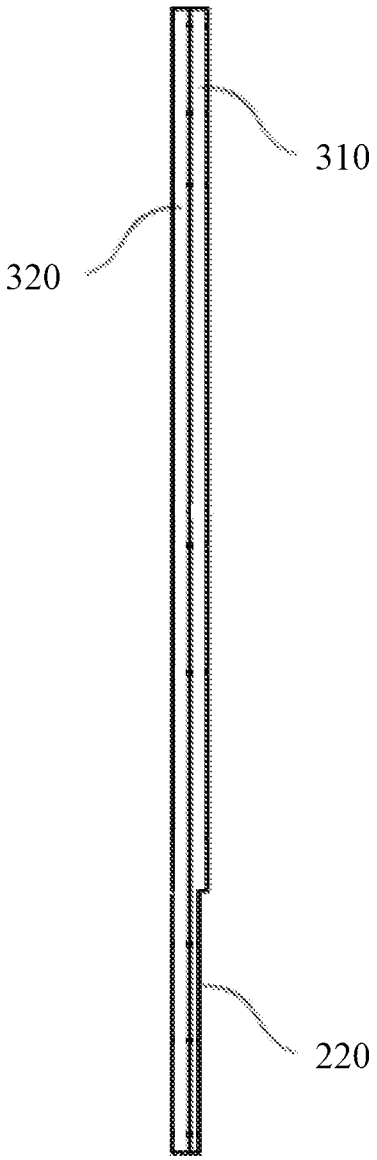
FIG. 5 is a side view drawing of a two-ply veneer plectrum.

Turning now to FIG. 5, shown is a side view of a plectrum 100 in which a first ply veneer 310 has been isomorphically adhered to a second ply veneer 320 and the thickness of the first ply veneer 310 is reduced in the area comprising the tip 220.

Figure 6:
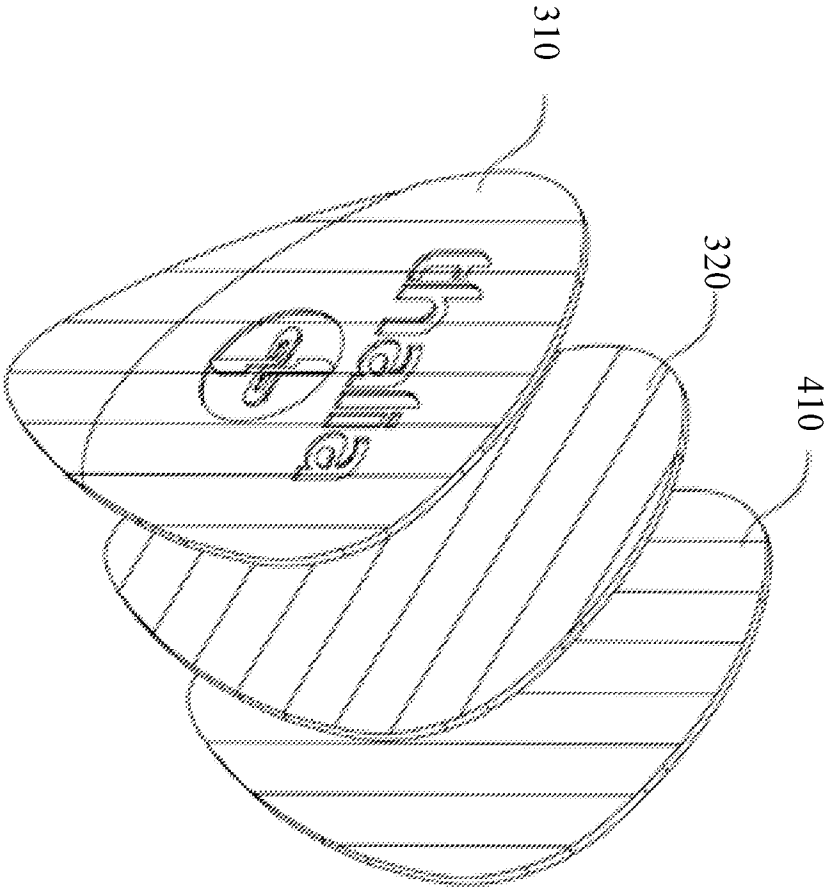
FIG. 6 is a front oblique view drawing of a three-ply veneer plectrum.

Turning now to FIG. 6, shown is an exploded front oblique view of a plectrum 100 comprising a first ply veneer 310, a second ply veneer 320, and a third ply veneer 410. Both the first ply veneer 310 and the third ply veneer 410 have grain orientations running vertically from the base to the apex and the second ply veneer 320 has a grain orientation that runs horizontally from leg to leg, thereby creating a cross-grain orientation in which each ply is offset by 90 degrees to each ply to which it is adhered.

Figure 7:
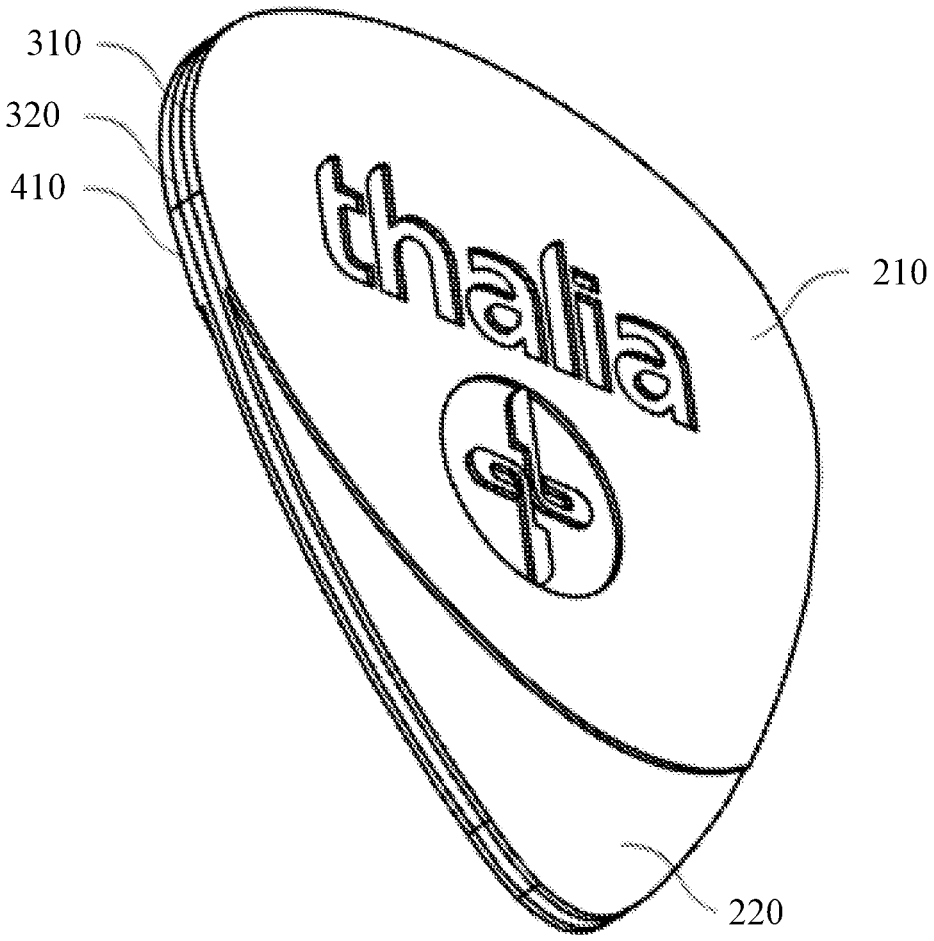
FIG. 7 is a front oblique view drawing of a three-ply veneer plectrum.

Turning now to FIG. 7, shown is a front oblique view of a plectrum 100 in which a first ply veneer 310 has been isomorphically adhered to a second ply veneer 320, and the second ply veneer has been isomorphically adhered to a third ply veneer 410, and in which can be discerned the grip 210 and the tip 220. Portions of the tip on both the first ply veneer 310 and third ply veneer 410 have been rastered, thereby providing for a thinner tip 220 with greater flexibility than the thicker grip 210.

Figure 8:
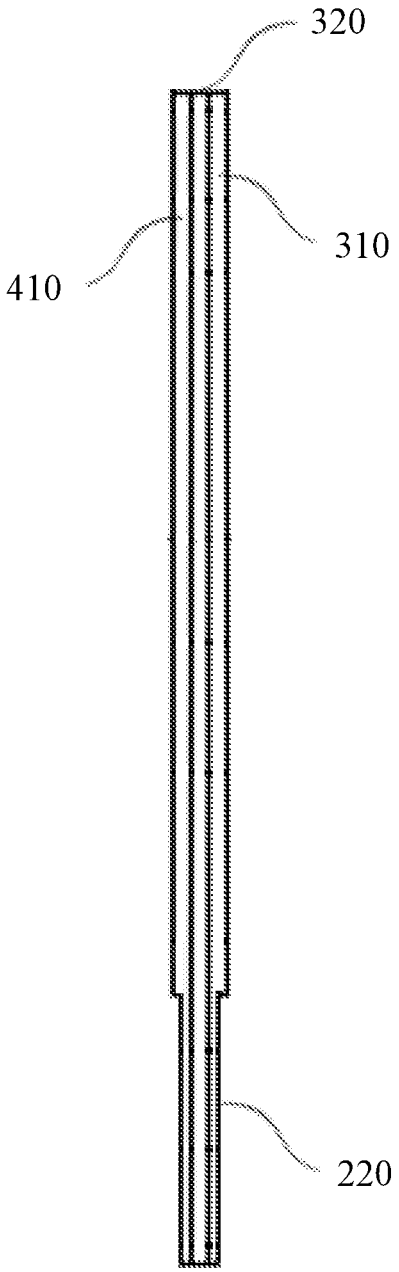
FIG. 8 is a side view drawing of a three-ply veneer plectrum.

Turning now to FIG. 8, shown is a side view of a plectrum 100 in which a first ply veneer 310 has been isomorphically adhered to a second ply veneer 320, and the second ply veneer has been isomorphically adhered to a third ply veneer 410, and the thickness of the first ply veneer 310 and third ply veneer 410 are reduced in the area comprising the tip 220.

Figure 9:
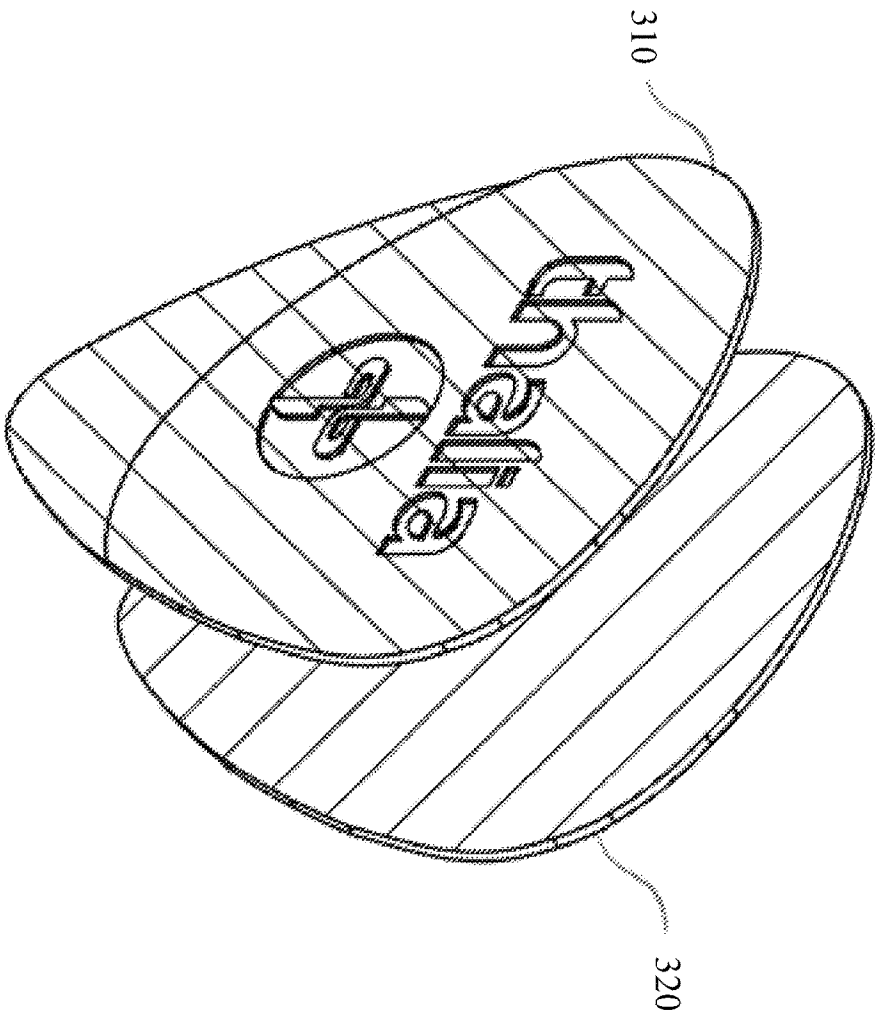
FIG. 9 is a front oblique view drawing of a first ply veneer and second ply veneer rotated at 45 degrees.

Turning now to FIG. 9, shown is an exploded front oblique view of a plectrum showing a first ply veneer 310 in which the grain orientation runs at a 45 degree angle to the vertical axis extending from the base to the apex and a portion of the tip has been rastered and a second ply veneer 320 in which the grain orientation runs at a 135 degree angle from the vertical axis, which corresponds to an angle of 90 degrees from the first ply veneer 310. When the first ply veneer 310 is adhered to the second ply veneer 320, the cross-grain orientations provide additional strength and durability to the plectrum 100. Because the force applied to the plectrum 100 from plucking a string is horizontal to the plane of the plectrum, orienting the grain at a non-horizontal offset provides more resilience and durability to the plectrum 100.

Figure 10:
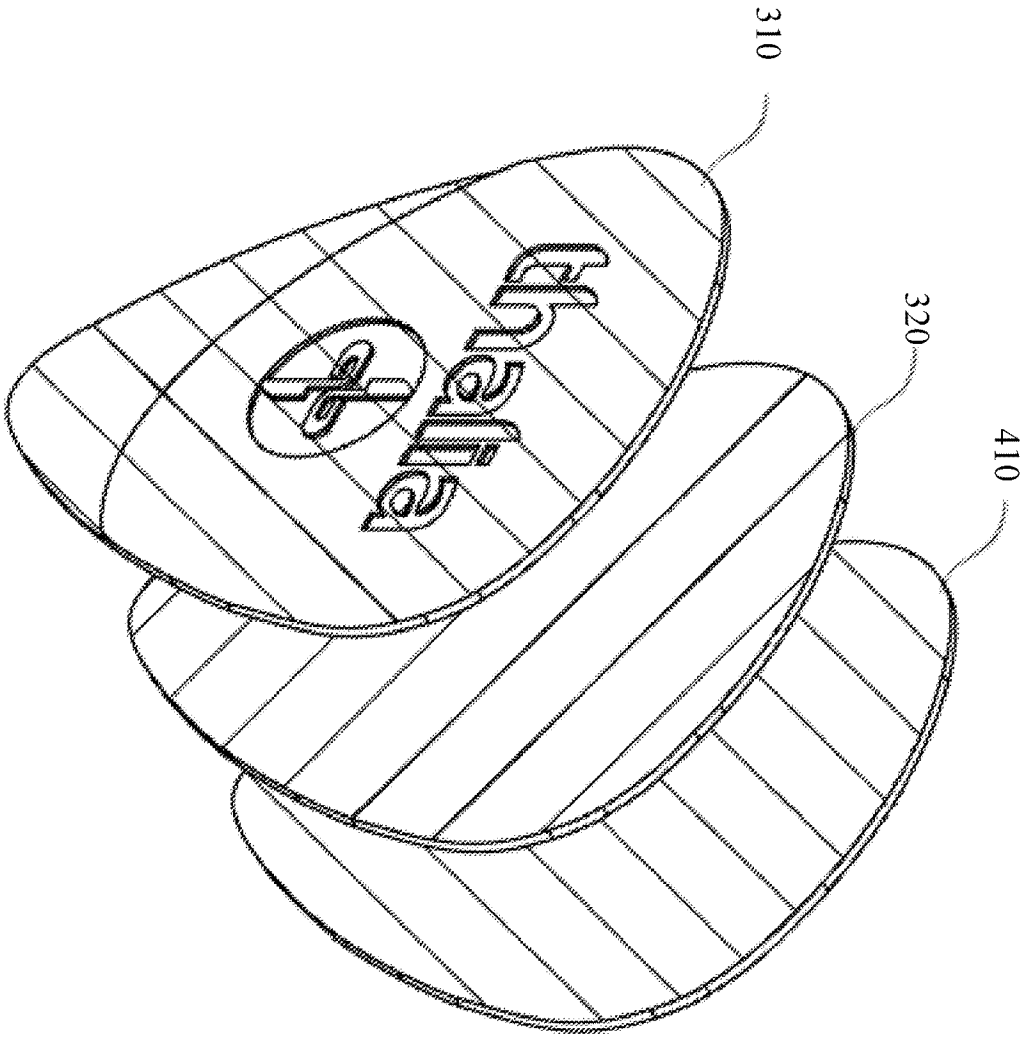
FIG. 10 is a front oblique view drawing of a three-ply veneer plectrum with the second ply rotated at 45 degrees.

Turning now to FIG. 10, shown is an exploded front oblique view of a plectrum 100 comprising a first ply veneer 310, a second ply veneer 320, and a third ply veneer 410. Both the first ply veneer 310 and the third ply veneer 410 have grain orientations running at a 45 degree angle to the vertical axis extending from the base to the apex, and the second ply veneer 320 has a grain orientation that runs at a 135 degree angle from the vertical axis, which corresponds to an angle of 90 degrees from both the first ply veneer 310 and third ply veneer 410, thereby creating a cross-grain orientation in which each ply is offset by 90 degrees to each ply to which it is adhered.

Figure 11:
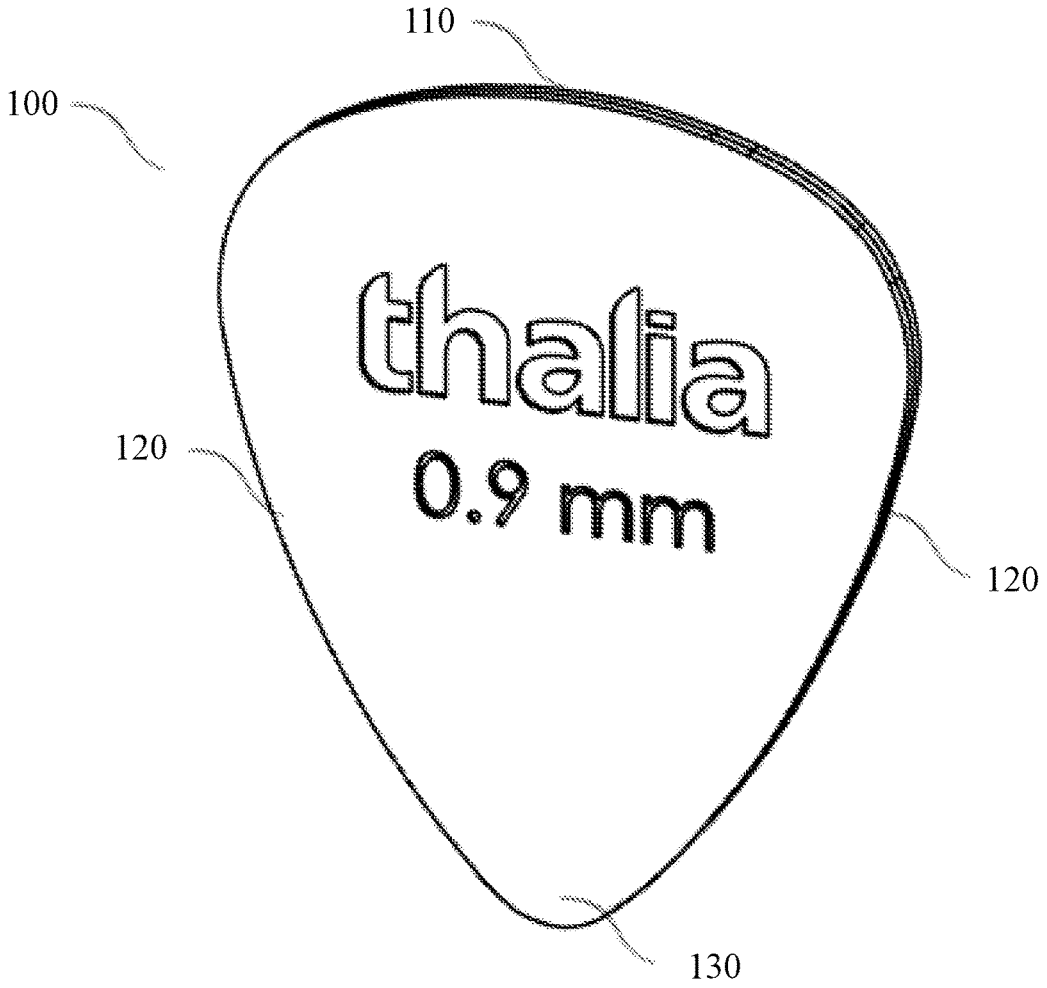
FIG. 11 is a front view drawing of a two-ply veneer plectrum.

Turning now to FIG. 11, shown is a front view of a two-ply plectrum 100 delineated by a base 110, two legs 120, and an apex 130.

Figure 12:
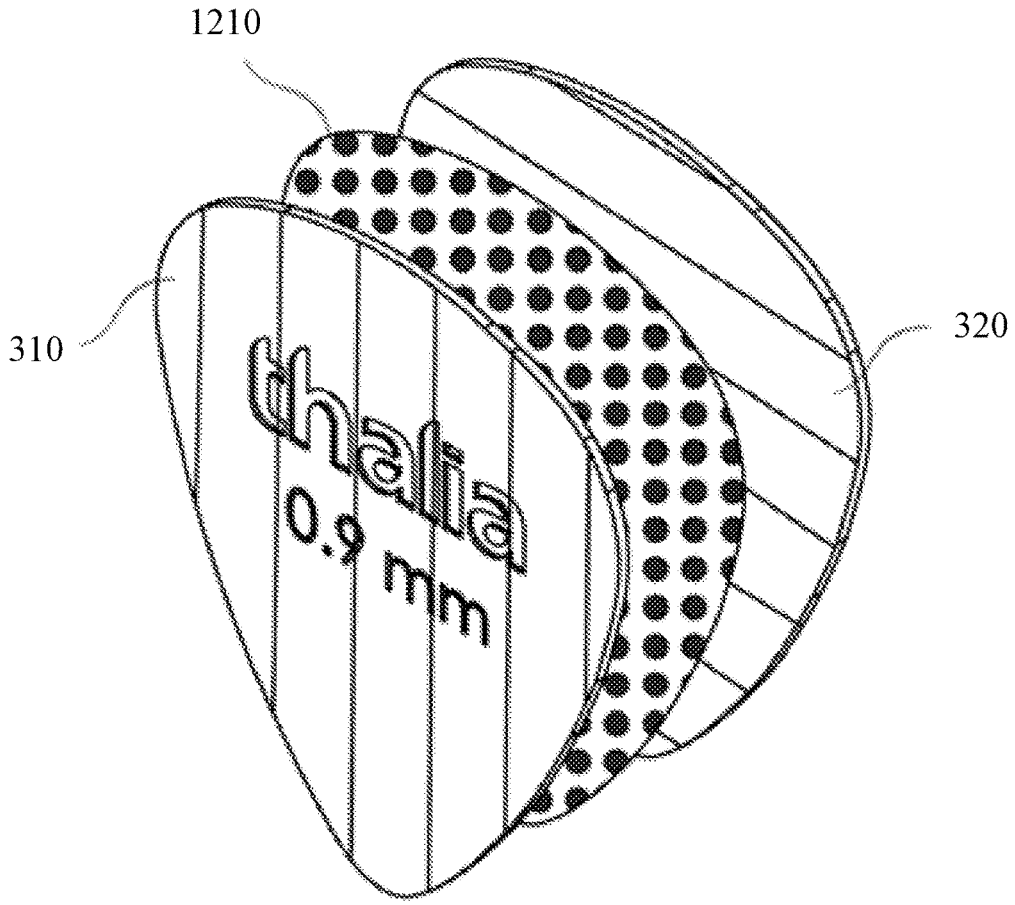
FIG. 12 is a front oblique view drawing of a two-ply veneer plectrum with adhesive.

Turning now to FIG. 12, shown is an exploded front oblique view of a plectrum showing a first ply veneer 310 in which the grain orientation runs vertically along the axis extending from the base to the apex, and a second ply veneer 320 in which the grain orientation runs at an offset of 90 degrees from grain orientation of the first ply veneer 310. The first ply veneer 310 is adhered to the second ply veneer 320 by the application of an adhesive 1210. In embodiments of the present invention, different adhesives 1210 may be used to obtain certain characteristics of the plectrum 100. Certain adhesives 1210 may affect the thickness of the plectrum 100. When the first ply veneer 310 is adhered to the second ply veneer 320, the cross-grain orientations provide additional strength and durability to the plectrum 100.

Figure 13:
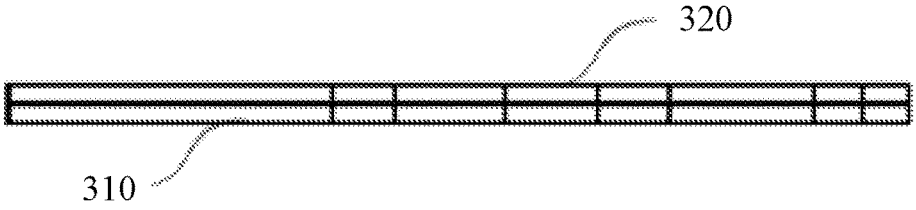
FIG. 13 is a side view drawing of a two-ply veneer plectrum.

Turning now to FIG. 13, shown is a side view of a plectrum 100 in which a first ply veneer 310 has been isomorphically adhered to a second ply veneer 320 and the thickness of the first ply veneer 310 and the second ply veneer is uniform. In one embodiment of the present invention, the first ply veneer 310 and the second ply veneer 320 are 0.45 mm thick, and the overall thickness of the plectrum is uniformly 0.9 mm.

Figure 14:
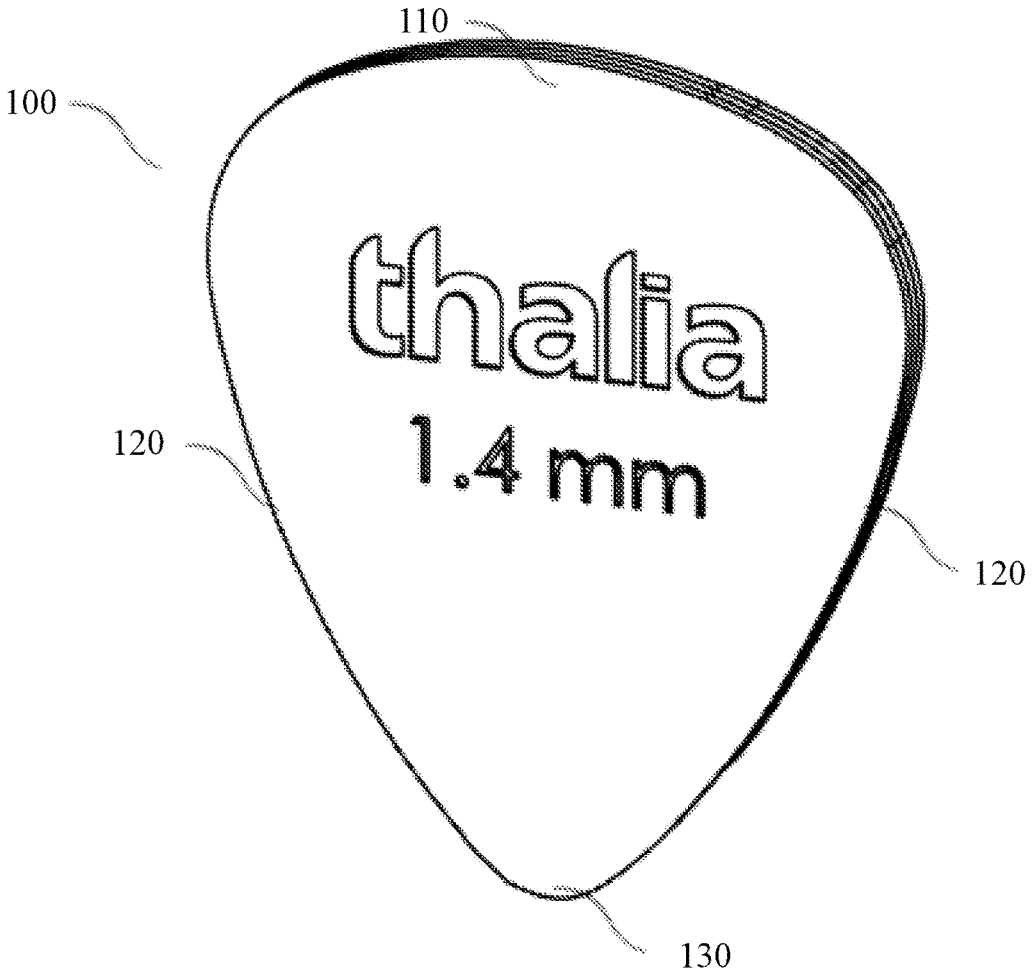
FIG. 14 is a front view drawing of a three-ply veneer plectrum.

Turning now to FIG. 14, shown is a front view of a three-ply plectrum 100 delineated by a base 110, two legs 120, and an apex 130.

Figure 15:
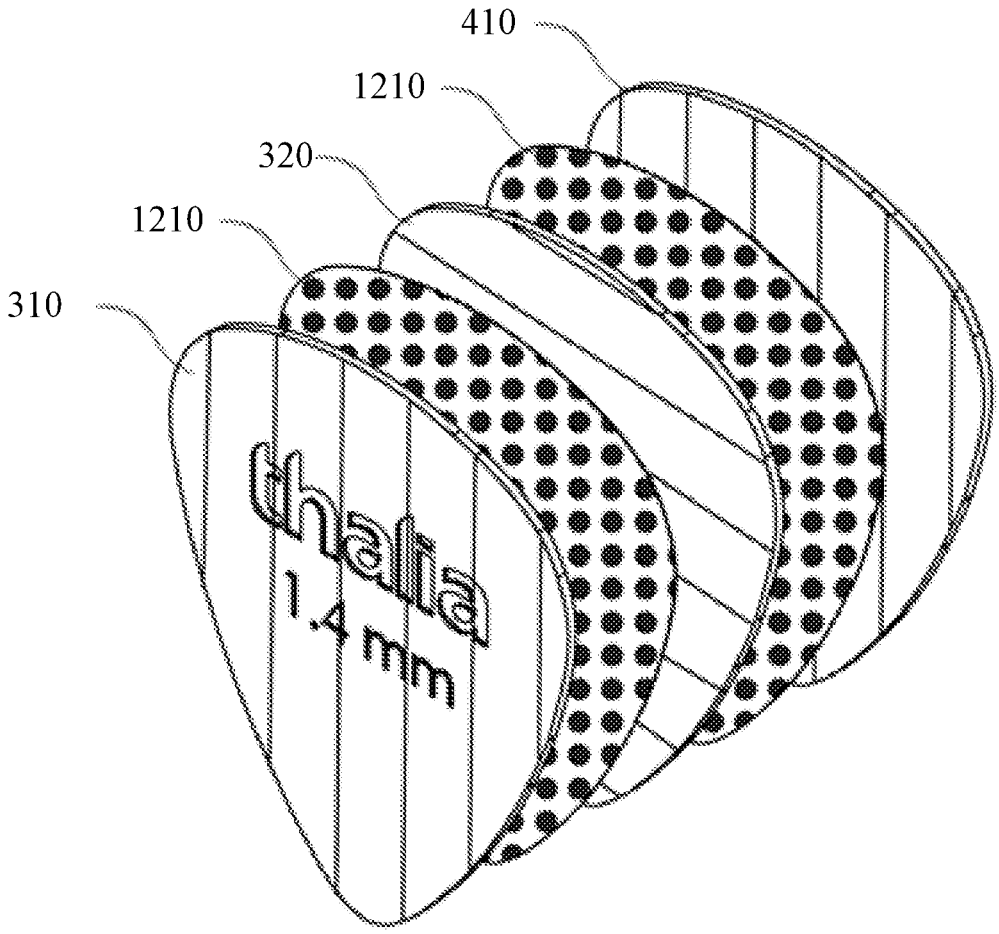
FIG. 15 is a front oblique view drawing of a three-ply veneer plectrum with adhesive.

Turning now to FIG. 15, shown is an exploded front oblique view of a plectrum showing a first ply veneer 310 and a third ply veneer 410 in which the grain runs vertically along the axis extending from the base to the apex, and a second ply veneer 320 in which the grain runs at an offset of 90 degrees from the grain orientation of the first ply veneer 310 and the third ply veneer 410. The second ply veneer 320 is adhered to the first ply veneer 310 and third ply veneer 410 by the application of an adhesive 1210. In embodiments of the present invention, different adhesives 1210 may be used to obtain certain characteristics of the plectrum 100. Certain adhesives 1210 may affect the thickness of the plectrum 100. When the second ply veneer 320 is adhered to the first ply veneer 310 and third ply veneer 410, the cross-grain orientations provide additional strength and durability to the plectrum 100.

Figure 16:
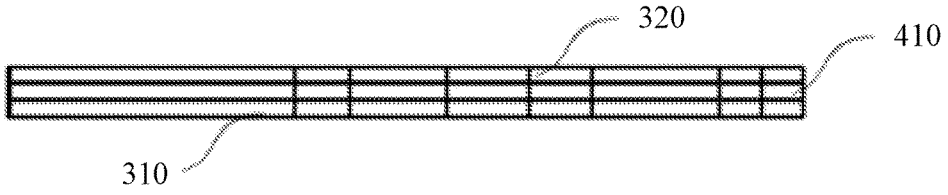
FIG. 16 is a side view drawing of a three-ply veneer plectrum.

Turning now to FIG. 16, shown is a side view of a three-ply plectrum 100 in which a second ply veneer 320 has been isomorphically adhered to a first ply veneer 310 and a third ply veneer 410. In one embodiment, the thickness of the first ply veneer 310, the second ply veneer 320 and the third ply veneer 410 is uniform. In one embodiment of the present invention, the first ply veneer 310, the second ply veneer 320 and the third ply veneer 410 are 0.45 mm thick, and the overall thickness of the plectrum is uniformly 1.4 mm.

Figure 17:
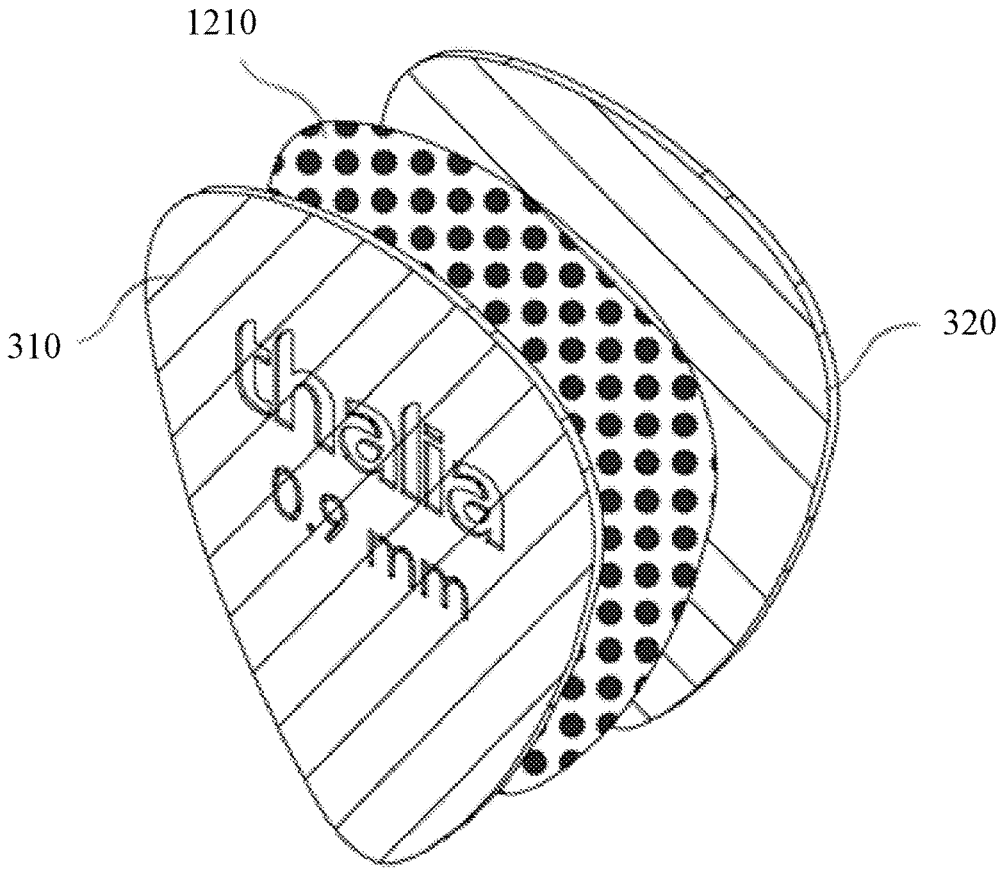
FIG. 17 is a front oblique view drawing of a two-ply veneer plectrum with adhesive with the second ply rotated at 45 degrees.

Turning now to FIG. 17, shown is an exploded front oblique view of a plectrum showing a first ply veneer 310 in which the grain orientation runs at a 45 degree angle from the vertical axis extending from the base to the apex, and a second ply veneer 320 in which the grain orientation runs at a 135 degree angle from the vertical axis, corresponding to an offset of 90 degrees from the first ply veneer 310. The first ply veneer 310 is adhered to the second ply veneer 320 by the application of an adhesive 1210. In embodiments of the present invention, different adhesives 1210 may be used to obtain certain characteristics of the plectrum 100. Certain adhesives 1210 may affect the thickness of the plectrum 100. When the first ply veneer 310 is adhered to the second ply veneer 320, the cross-grain orientations provide additional strength and durability to the plectrum 100. Because the force applied to the plectrum 100 from plucking a string is horizontal to the plane of the plectrum, orienting the grain at a non-horizontal offset provides more resilience and durability to the plectrum 100.

Figure 18:
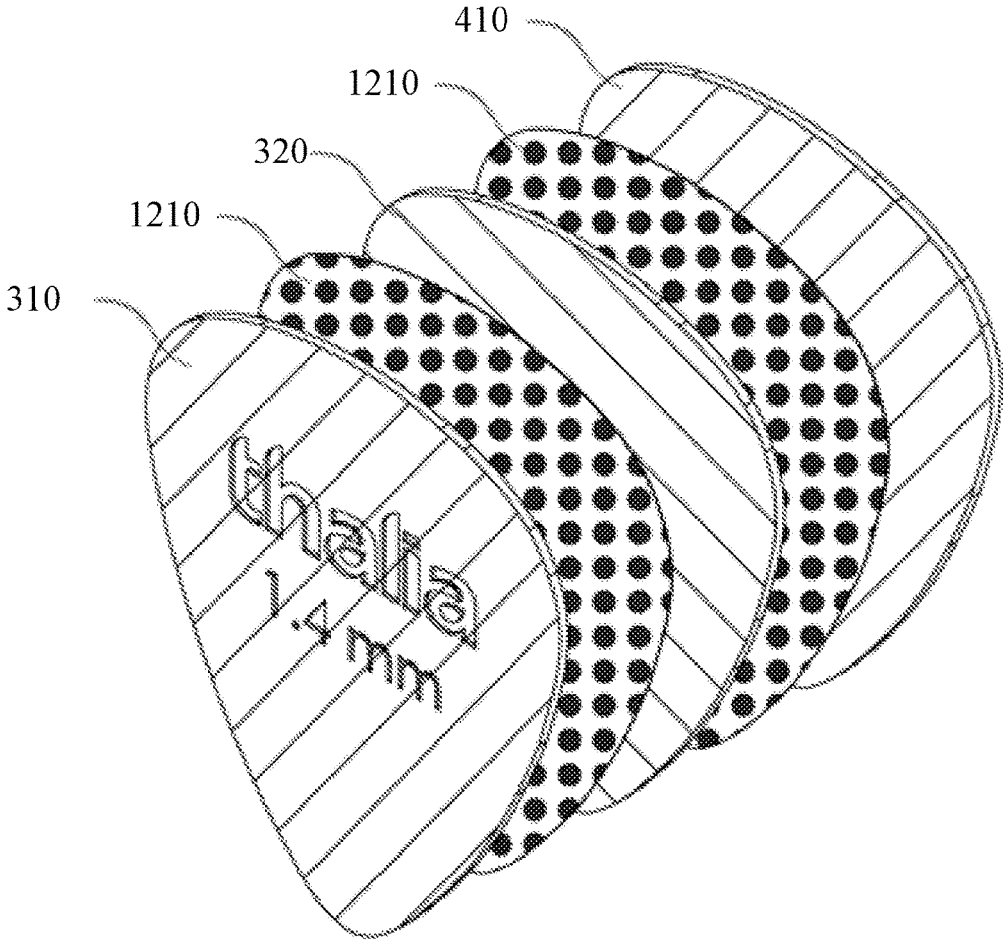
FIG. 18 is a front oblique view drawing of a three-ply veneer plectrum with adhesive with the second ply rotated at 45 degrees.

Turning now to FIG. 18, shown is an exploded front oblique view of a plectrum showing a first ply veneer 310 and a third ply veneer 410 in which the grain runs at a 45 degree angle to the vertical axis extending from the base to the apex, and a second ply veneer 320 in which the grain runs at an offset of 135 degrees from the vertical axis, which corresponds to a 90 degree angle to the first ply veneer 310 and third ply veneer 410. The second ply veneer 320 is adhered to the first ply veneer 310 and third ply veneer 410 by the application of an adhesive 1210. In embodiments of the present invention, different adhesives 1210 may be used to obtain certain characteristics of the plectrum 100. Certain adhesives 1210 may affect the thickness of the plectrum 100. When the second ply veneer 320 is adhered to the first ply veneer 310 and third ply veneer 410, the cross-grain orientations provide additional strength and durability to the plectrum 100. Because the force applied to the plectrum 100 from plucking a string is horizontal to the plane of the plectrum, orienting the grain at a non-horizontal offset provides more resilience and durability to the plectrum 100.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A plectrum for use with stringed instruments, said plectrum comprising:

a first ply veneer comprising a base, two legs and an apex manufactured from a wood based material with a grain orientation;

a second ply veneer comprising a base, two legs and an apex manufactured from a wood based material with a grain orientation, wherein said second ply veneer is isomorphic in shape and size to said first ply veneer and wherein said grain orientation of said second ply veneer is different from said grain orientation of said first ply veneer;

an adhesive, wherein said adhesive is applied to the interior faces of said first ply veneer and said second ply veneer thereby fixedly attaching said first ply veneer isomorphically to said second ply veneer whereby said grain orientation of said second ply veneer is different from said grain orientation of said first ply veneer;

wherein a portion of said first ply veneer distal to said apex of said first ply veneer contains apertures.

2. The plectrum of claim 1, wherein said apertures are configured to accept inserts.

3. The plectrum of claim 2, wherein said inserts comprise shell.

4. The plectrum of claim 1 wherein said apertures are in the shape of numbers, letters, a picture, or a combination thereof.

5. The plectrum of claim 1 wherein said apertures comprise a series of small holes, wherein said series of small holes provide tactile feedback.

6. The plectrum of claim 5 wherein said series of small holes are configured in a design pattern.

7. A plectrum for use with stringed instruments, said plectrum comprising:

a first ply veneer comprising a base, two legs and an apex manufactured from a wood based material with a grain orientation;

a second ply veneer comprising a base, two legs and an apex manufactured from a plastic based material, wherein said second ply veneer is isomorphic in shape and size to said first ply veneer;

a third ply veneer comprising a base, two legs and an apex manufactured from a wood based material with a grain orientation, wherein said third ply veneer is isomorphic in shape and size to said second ply veneer and wherein said grain orientation of said third ply veneer is different from said grain orientation of said first ply veneer;

an adhesive, wherein said adhesive is applied to the interior faces of said first ply veneer and said third ply veneer and both faces of said second ply veneer thereby fixedly attaching said first ply veneer isomorphically to said second ply veneer and fixedly attaching said second ply veneer isomorphically to said third ply veneer, whereby said grain orientation of said second ply veneer is different from said grain orientation of said first ply veneer and said grain orientation of said third ply veneer.

8. The plectrum of claim 7, wherein a portion of said first ply veneer proximal to said apex of said first ply veneer is thinner than the remainder of said first ply veneer.

9. The plectrum of claim 7, wherein a portion of said first ply veneer proximal to said apex of said first ply veneer is thinner than the remainder of said first ply veneer and a portion of said third ply veneer proximal to said apex of said third ply veneer is thinner than the remainder of said third ply veneer.

10. The plectrum of claim 8, wherein said thinner portion of said first ply veneer is created by rastering said thinner portion with a laser.

11. The plectrum of claim 9, wherein said thinner portion of said first ply veneer and said thinner portion of said third ply veneer are created by rastering said thinner portion of first ply veneer and said thinner portion of said third ply veneer with a laser.

12. The plectrum of claim 7 wherein said first ply veneer and said second ply veneer and said third ply veneer are each 0.45 mm thick.

13. The plectrum of claim 1 wherein said grain orientation of said first ply veneer and said third ply veneer is oriented at a 45 degree angle from the axis extending from said base to said apex, and said grain orientation of said second ply veneer is 90 degrees offset from said grain orientation of said first ply veneer and said third ply veneer.

14. A method of manufacturing a plectrum for use with stringed instruments, said method comprising:

laser cutting a first ply veneer comprising a base, two legs and an apex manufactured from a wood based material with a grain orientation;

laser cutting a second ply veneer comprising a base, two legs and an apex manufactured from a wood based material with a grain orientation, wherein said second ply veneer is isomorphic in shape and size to said first ply veneer and wherein said grain orientation of said second ply veneer is different from said grain orientation of said first ply veneer;

applying adhesive to the interior faces of said first ply veneer and said second ply veneer thereby fixedly attaching said first ply veneer isomorphically to said second ply veneer whereby said grain orientation of said second ply veneer is different from said grain orientation of said first ply veneer;

applying a laser beam to burn to a slight depth said first ply veneer and said second ply veneer proximal to an edge of each of said first ply veneer and said second ply veneer and moving said laser beam to said edge of said first ply veneer and said second ply veneer while simultaneously increasing energy of said laser beam as it moves, thereby creating a bevel on said edge of said first ply veneer and said second ply veneer.

15. The plectrum of claim 14, wherein a portion of said first ply veneer proximal to said apex of said first ply veneer is thinner than the remainder of said first ply veneer.

16. The plectrum of claim 15, wherein said thinner portion of said first ply veneer is created by rastering said thinner portion with said laser beam.

* * * * *